United States Patent [19]

D'Alessandro

[11] Patent Number: 4,485,797

[45] Date of Patent: Dec. 4, 1984

[54] WOOD BURNING STOVE AND OVEN

[76] Inventor: Sebastiano D'Alessandro, 74 Knockbolt Crescent, Scarborough, Ontario M1S 2P6, Canada

[21] Appl. No.: 524,665

[22] Filed: Aug. 19, 1983

[51] Int. Cl.[3] ..... F24C 1/00

[52] U.S. Cl. ..... 126/1 A; 126/6

[58] Field of Search ..... 126/1 A, 1 AA, 3, 4, 126/6, 273 R, 60, 65, 66, 67, 80, 210

[56] References Cited

U.S. PATENT DOCUMENTS 2,072,276 3/1937 Pickup ..... 126/1 A 4,178,906 12/1979 Lund ..... 126/6

FOREIGN PATENT DOCUMENTS 224547 7/1910 Fed. Rep. of Germany ..... 126/1 A

*Primary Examiner*—Samuel Scott

*Assistant Examiner*—G. Anderson

*Attorney, Agent, or Firm*—George A. Rolston

[57] ABSTRACT

This invention is a wood burning stove comprising an essentially air tight firebox module having three or more sides, an essentially horizontal cooking top and a bottom, both of said cooking top and bottom extending outwardly from a side to form firebox oven flanges, to which may be secured an oven module, a fire door at the front of the firebox, a draft control means, a chimney attachment means, disposed to the rear and the top of the firebox, a grate, and leg support means.

4 Claims, 6 Drawing Figures

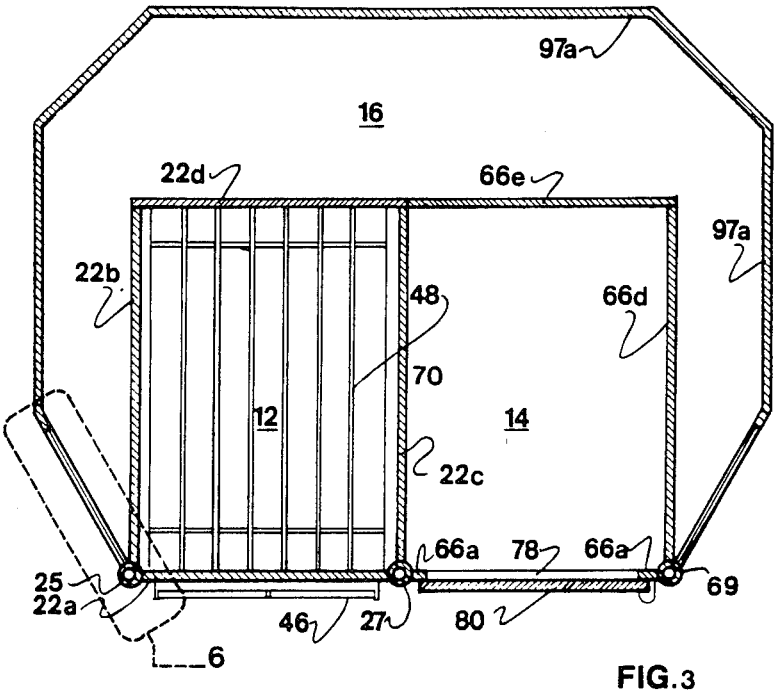
FIG. 3
FIG. 4
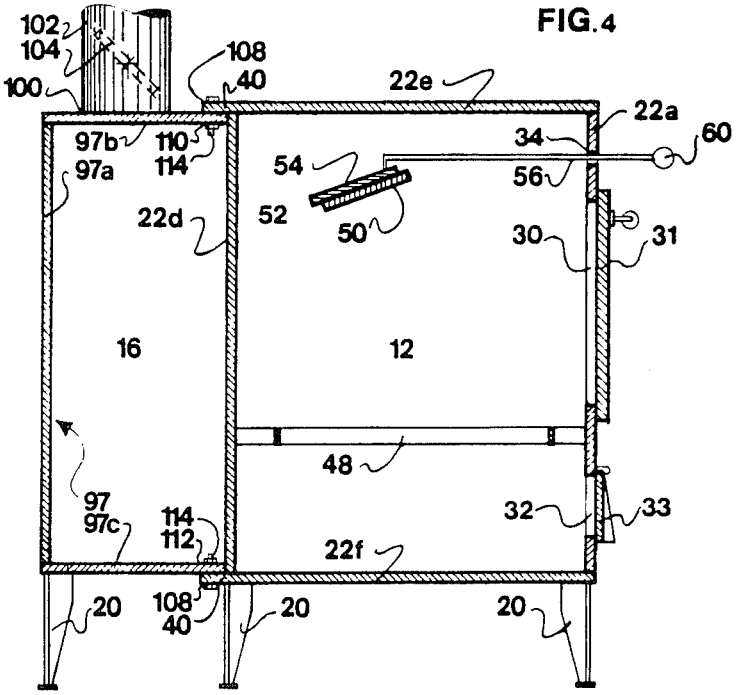

WOOD BURNING STOVE AND OVEN

The invention relates to a combination wood burning stove and oven, having an air heater for use in association with a home heating system.

BACKGROUND OF THE INVENTION

The conventional wood burning stove is an integral unit containing a firebox with a cooking top and an oven. Generally speaking, stoves are constructed of heavy gauge metal to ensure a reasonably long, useful and safe life. Such stoves are heavy and large, and tend to be cumbersome to move and to install. Some stoves may be integral units comprising only a firebox and a cooking top. While simpler to install, these heaters do not have the capacities of the larger firebox-oven stoves. As well, conventional stoves do not have the ability to heat air for use in association with home heating systems.

The invention overcomes these disadvantages of conventional wood burning stoves by providing a firebox-oven stove of modular design having a removable oven and a removable air heating chamber which may be used in association with home heating systems.

Accordingly, it is an object of this invention to provide a firebox-oven stove from which the oven may be temporarily removed for ease of installation.

It is a further object of this invention to provide a firebox-cooking top stove to which an oven may be separately and subsequently purchased and attached.

It is a further object of this invention to provide a removable air heating chamber on the firebox-oven stove and on the firebox-cooking top stove through which air may be drawn by a home heating system for distribution about the building.

Other objects and advantages of the invention will become apparent upon a review of the following specification.

BRIEF SUMMARY OF THE INVENTION

The invention comprises a wood burning stove in modular form comprising a firebox, an oven and an air heating chamber. The invention comprises an essentially air tight firebox module having three or more sides, an essentially horizontal cooking top and a bottom, both of said cooking top and bottom extending outwardly from a side to form firebox oven flanges, to which may be secured an oven module, a fire door at the front of the firebox, a draft control means, a chimney attachment means disposed to the rear and the top of the firebox, a grate, and leg support means.

The various features of novelty which characterize the invention are pointed out with particularity in the claims annexed to and forming a part of this disclosure. For a better understanding of the invention, its operating advantages and specific objects attained by its use, reference should be had to the accompanying drawings and descriptive matter in which there are illustrated and described preferred embodiments of the invention.

IN THE DRAWINGS

FIG. 3 is a plan view in cross-section along the plane 4—4 (dash-dot-dot lines) of FIG. 1;

FIG. 4 is a side elevation in cross-section along the plan 5—5 (dash-dot lines) of FIG. 1, and, FIG. 5 is a perspective view in partial section of detail 6 of FIG. 3.

DESCRIPTION OF A SPECIFIC EMBODIMENT

Figure 1:
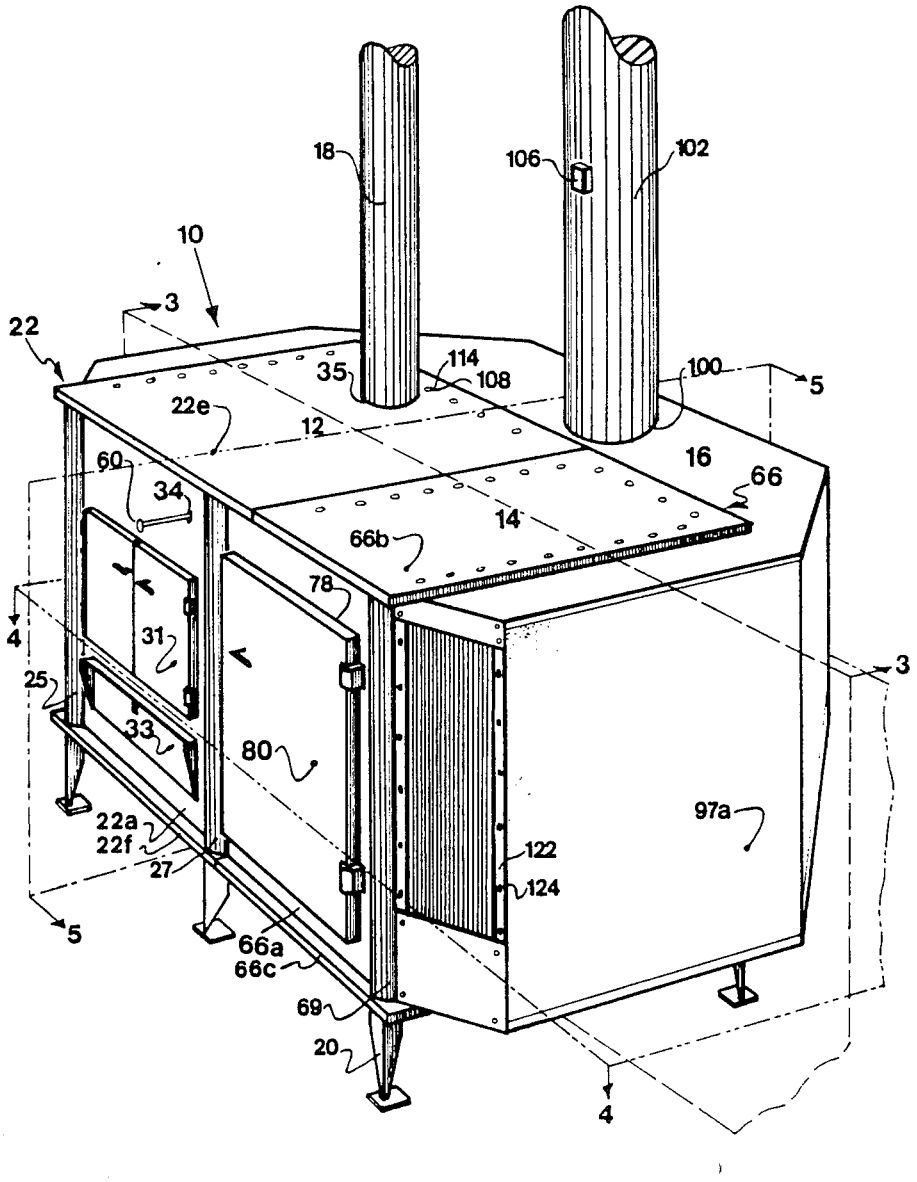
FIG. 1 is a perspective view.
Figure 2:
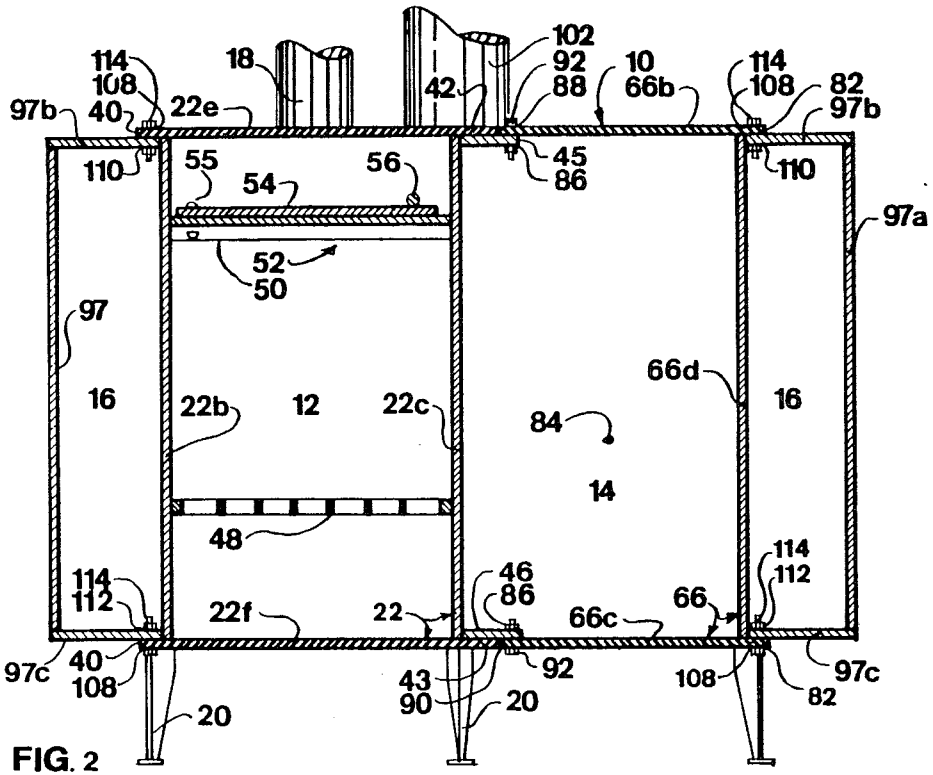
FIG. 2 is a front elevation in partial section along the plan 3—3 (dashed lines) of FIG. 1.
Figure 5:
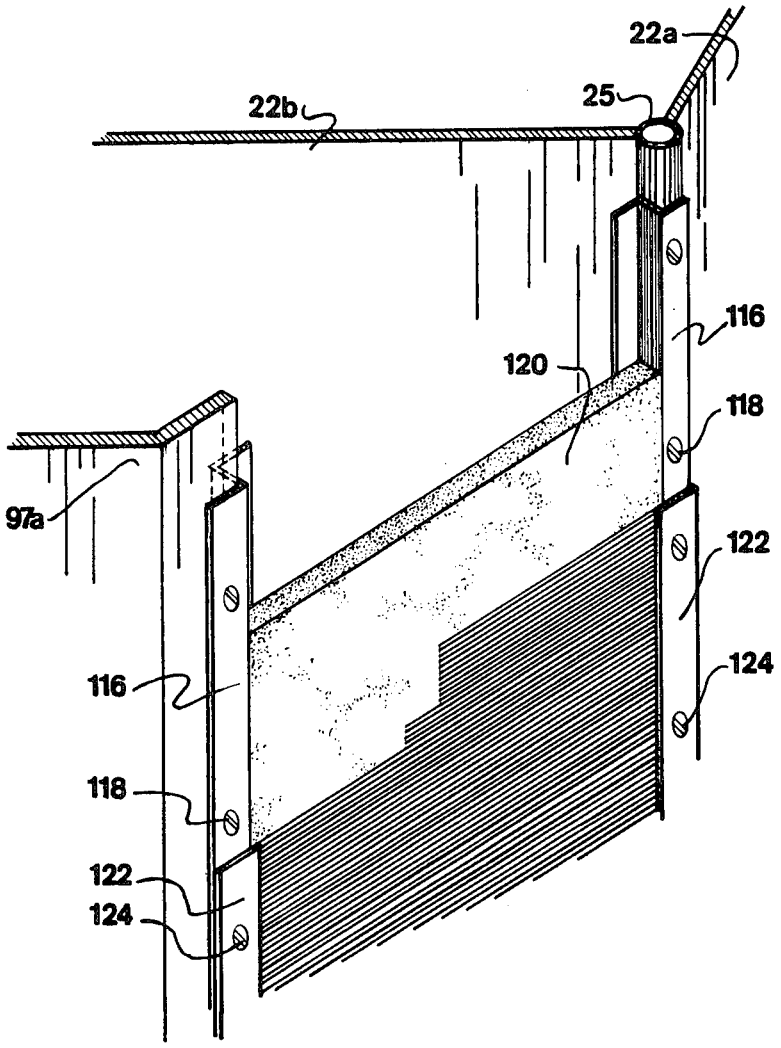

Referring more specifically to the figures, FIG. 1 illustrates a wood burning stove 10, having a firebox 12, and oven 14, and an air heating chamber 16. The flue gases escape from the stove 10 through chimney 18. The stove 10 is supported by legs 20.

The basic components, namely the firebox 12, oven 14, and air heating chamber 16 are modular in construction. The firebox 12 can be installed and used on its own, and the other components can, if desired, be installed at different times. This greatly facilitates manufacture, sale, shipping and installation of the invention by reducing the unit weight of the individual components, and also enabling a purchaser to buy the components as he needs them.

The firebox 12 and oven 14 can each have any number of sides, greater than two, convenient for modular construction. The firebox 12 and the oven 14 each have a front side. In the embodiment shown, both firebox 12 and oven 14 have four sides each.

The firebox 12 comprises a box 22, which may be cast as an integral unit or formed by joining together in an airtight fashion front plate 22A, pipe 25, side plate 22B, pipe 27, side plate 22C, back plate 22D, cooking top 22E and bottom 22F. Front plate 22A is welded to pipe 25 along a first side. Side plate 22B is also welded to pipe 25. Front plate 22A is also welded to pipe 27 along a second side. Side plate 22C is welded to pipe 27. The front plate 22A defines an opening 30 within which fire doors 31 may be hung in any fashion conventionally used in wood burning stoves. Front plate 22A also defines an opening 32 within which a draft control means 33 of any sort conventionally used in wood burning stoves, is fitted. Front plate 22A further defines a damper rod opening 34. Cooking top 22E defines an opening 35 within which chimney 18 may be affixed in any fashion conventionally used in wood burning stoves. When the stove 10 is installed, cooking top 22E must be substantially horizontal in order to facilitate cooking.

Both cooking top 22E and bottom 22F extend beyond back plate 22D and side plates 22B and 22C. Flanges 40 are thus formed along the top and bottom of box 22 on the rear and on a side, disposed away from oven 14, of box 22. Flange 42 is formed along the top and flange 43 along the bottom of box 22 on a side of box 22 disposed to receive oven 14. Bar 45 is affixed to and below flange 46. Bar 65 is attached to and above flange 43. Legs 20 may be attached to bottom 22F in any conventional fashion. Grate 48 is affixed in place in firebox 12 above opening 32 in such a position that wood may be easily inserted into the firebox 12.

Baffle plate 50 is affixed to side plates 22B and 22C and disposed toward the rear of firebox 12. Baffle plate 50 extends sufficiently toward the front of firebox 12 to define a flue gas exit path extending upward from grate 48 across the top of the interior of the firebox 12 and thence rearward to chimney 18. Baffle plate 50, back plate 22D, and side plates 22B and 22C define an opening 52, which will allow flue gas to escape more or less directly up chimney 18. Damper 54 is pivotally mounted at a corner 55 in such a fashion that damper 54 can rotatably slide on baffle plate 50 to cover and uncover opening 52. Damper rod 56 is affixed at a first end to damper 54 in such a fashion that damper rod 56 may operate to rotatably slide damper 54 on baffle plate 50 to cover or uncover opening 52. Damper rod 56 extends from damper 54 through damper rod opening 34 to a point external to firebox 12. A second end of damper rod 56 defines damper rod handle 60.

Firebricks (not shown) may be inserted inside firebox 12 adjacent to side plates 22B and 22C and back plate 22D to protect and prolong the life of the stove 10.

The oven 14 comprises an open-sided box 66, which may be cast as an integral unit or formed by joining together in an air tight fashion front plate 66A, top plate 66B, bottom plate 66C, side plate 66D and back plate 66E. Front plate 66A is welded to pipe 69 along a side disposed away from the firebox 12. Side plate 66D is also welded to pipe 69. Box 66 defines an open side 70. Oven 14 is attached to firebox 12 in such a fashion that open side 70 is adjacent to side plate 22C.

Front plate 66A defines an opening 78, within which a door 80 may be hung in any fashion conventionally used in wood burning stoves. Top plate 66B and bottom plate 66C extend beyond side plate 66D and back plate 66E to form flanges 82 along the top and bottom of box 66. Legs 20 may be attached to bottom plate 66C in any conventional fashion.

Box 66 is fitted over bars 45 and 46 on the firebox 12. Box 66 may permanently be affixed to bars 45 and 46 or, as in the embodiment illustrated, bolted to bars 45 and 46. Bars 45 and 46 define holes 86, top plate 66B defines holes 88 and bottom plate 66C defines holes 90 for the purpose of allowing nuts and bolts 92 to secure the box 66 to bars 45 and 46.

In a further embodiment of the invention, bars 45 and 46 may be affixed to top plate 66B and bottom plate 66C of box 66, respectively. Box 66 is then attached to firebox 12 by fitting bars 45 and 46 between flanges 42 and 43 and bolting same together. Such an embodiment may improve the modular aspects of the stove.

The air heating chamber 16 comprises an enclosure 97 shaped to wrap around firebox 12 or, as in the embodiment illustrated, around firebox 12 and oven 14.

Enclosure 97 is formed by joining together in an air-tight fashion an outer envelope 97A, top 97B and bottom 97C. The material of enclosure 97 may be of lighter gauge than that of firebox 12 or oven 14 and may be sheet metal. Top 97B defines an opening 100 within which air duct 102 leading to the intake of the home heating furnace (not shown) may be affixed. Damper 104, controlled by controlling means 106, may be installed in duct 102 to control the flow of air and the temperature of air flowing to the home heating furnace. Enclosure 97 is placed around firebox 12 and oven 14 and attached to flanges 40 and 82. In the embodiment illustrated, the enclosure 97 is bolted to flanges 40 and 82. Flanges 40 and 82 define holes 108, top 97B defines holes 110, and bottom 97C defines holes 112 for the purpose of allowing nuts and bolts 114 to secure enclosure 97 to flanges 40 and 82.

Filter frames 116 are affixed to enclosure 97 and to each of pipes 25 and 69. Filter frames 116 and pipes 25 and 69 define tapped holes (not shown) for the purpose of allowing bolts 118 to secure the filter frames 116 to the enclosure 97 and to pipes 25 and 69. Filters 120 and protective grills 122 are affixed within filter frames 116. In the embodiment illustrated, the grills 122, which hold the filters 120 in place, are bolted to filter frames 116 by bolts 124.

Figure 6:
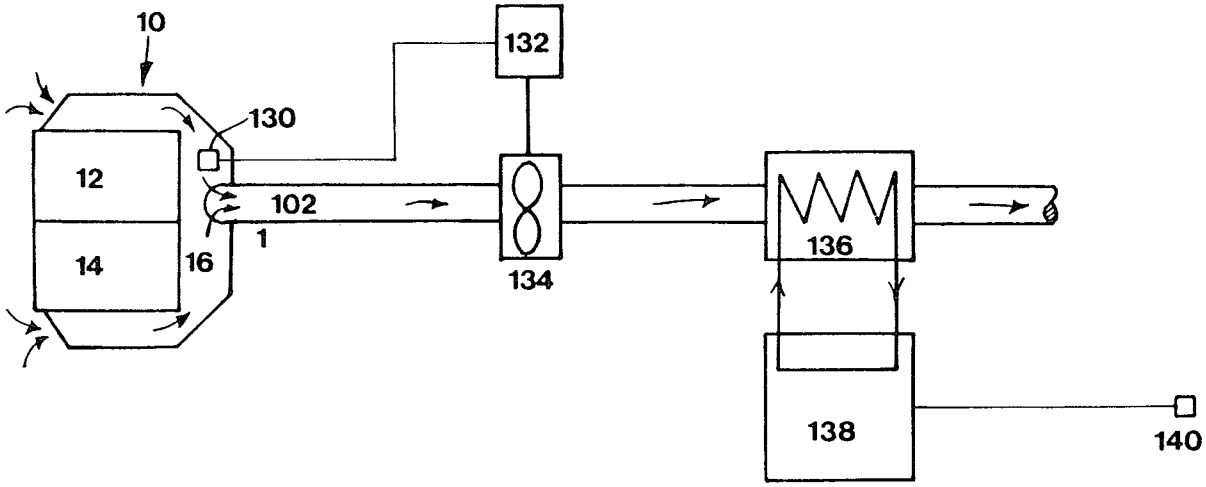
FIG. 6 is a schematic diagram of one embodiment of the invention used in association with a home heating system.

The stove may be utilized as an element of a home heating system by installing a suitable control system. FIG. 6 illustrates one such system. Stove 10 is fitted with a temperature sensitive switch 130, set to close when the temperature of air heating chamber 16 reaches a pre-determined upper limit and to open when said temperature reaches a pre-determined lower limit. When switch 130 is closed, motor 132 will operate to turn fan 134. Fan 134 draws air from air heating chamber 16 and passes it to heat exchanger 136. The air may be further heated in heat exchanger 136 by a fluid heated by furnace 138. From heat exchanger 136 the warm air may be distributed throughout the house. The operation of furnace 138 is controlled by thermostat 140, which will cause furnace 138 to operate if the temperature in the house falls below a pre-determined limit. Thus, furnace 138 only operates to supplement the heat output of stove 10. If stove 10 is not operating, furnace 138 will carry the entire heating load of the house. If stove 10 is sufficient to meet the heating load of the house, then the temperature of the house must be controlled by varying the amount of wood burned in the firebox 12.

To operate the stove, a fire is started in the firebox 12. During start-up, damper 54 is slid to the forward position to expose opening 52, thus allowing the initial flue gas to escape more or less directly up chimney 18. The straighter flue gas exit path through opening 52 reduces the amount of combustible deposits in the firebox 12 and chimney 18 during start-up. When the firebox 12 has reached its operating temperature, damper 54 is slid to the rearward position to close opening 52, thus forcing the flue gas to pass around baffle plate 50 before entering the chimney 18. This manner of operation allows the stove to be used in a cleaner, safer, and more efficient fashion.

In a further embodiment of the invention, it is possible to provide an air heating chamber to surround only the firebox. In such an embodiment, there is no oven.

The flanges along the top and bottom of the firebox and oven allow for variations in design of a modular stove to suit the requirements of the user. Either an oven module, an air heating chamber module or both may be attached to a firebox module.

In further embodiments of the invention, the firebox, oven and air heating chamber may have any shape which will allow the heater to be assembled from and dismantled into its firebox, oven and air heating chamber components.

In further embodiments of the invention, it is possible to provide a guard rail means around the stove top to prevent objects from falling off the stove. It is also possible to provide a hearth plate means, horizontally extending forward from the bottom front of the stove, to protect the floor from embers, coals and soot that may escape from the firebox.

The foregoing is a description of a preferred embodiment of the invention which is given here by way of example only. The invention is not to be taken as limited to any of the specific features as described, but comprehends all such variations thereof as come within the scope of the appended claims.

What is claimed is:

1. A wood burning stove comprising an essentially air tight firebox module having three or more sides including a front side, an essentially horizontal cooking top and a bottom, both of said cooking top and bottom extending outwardly from all sides except the front side to form firebox flanges;

a fire door at the front of the firebox;

a draft control means;

a chimney attachment means disposed to the rear and the top of the firebox;

a grate;

leg support means;

an air tight oven module secured to the said firebox flanges, said oven module having an oven door, three or more sides including an open side which is secured to the firebox module and a front side, an essentially horizontal top and a bottom, the said horizontal top and bottom extending outwardly from all sides except the front and open sides to form oven flanges, and, an air tight air heating chamber module secured to the said firebox and oven flanges, said air heating chamber module having an outlet duct which may be connected to a home heating system and air intakes disposed to one side of the front side of the firebox module and to the other side of the front side of the oven module.

2. A wood burning stove as claimed in claim 1 wherein the said firebox module includes a baffle within the firebox extending toward the front of the firebox to define a flue gas exit path extending upward from the grate across the top of the interior of the firebox and thence rearward to the chimney, said baffle defining an opening between the baffle and the rear of the firebox;

a baffle opening damper rotatably and slidably mounted on the baffle, and, a damper operating means attached to and extending from the damper through an opening defined for the damper operating means in a wall of the firebox to a point external to the firebox, operable to slide the damper on the baffle to cover and uncover said opening.

3. A wood burning stove as claimed in claim 2 wherein the said air intakes are fitted with filters and protective grilles and the said outlet duct is fitted with a damper and is controllable by a controlling means operable to regulate the flow of air and the temperature of air flowing to the home heating system.

4. A wood burning stove as claimed in claim 1 wherein the said oven module may be secured to the said firebox module by means of bars affixed to both the said firebox oven flanges and to the said horizontal oven top and oven bottom.

* * * * *